US007607299B2

(12) United States Patent
Carroll

(10) Patent No.: US 7,607,299 B2
(45) Date of Patent: Oct. 27, 2009

(54) THERMAL CYCLE ENGINE WITH AUGMENTED THERMAL ENERGY INPUT AREA

(75) Inventor: Joseph P Carroll, Moorpark, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 0 days.

(21) Appl. No.: 11/200,303

(22) Filed: Aug. 9, 2005

(65) Prior Publication Data

US 2007/0033935 A1 Feb. 15, 2007

(51) Int. Cl.
*F01B 29/10* (2006.01)

(52) U.S. Cl. ..... 60/524; 60/517

(58) Field of Classification Search ..... 60/517, 60/520, 524, 526
See application file for complete search history.

(56) References Cited

U.S. PATENT DOCUMENTS

| | | | | | |
|---|---|---|---|---|---|
| 3,152,260 | A | | 10/1964 | Cummiogs | |
| 4,203,425 | A | | 5/1980 | Clark | |
| 4,249,377 | A | * | 2/1981 | Bratt et al. | 60/517 |
| 4,296,731 | A | | 10/1981 | Cluff | |
| 4,335,578 | A | | 6/1982 | Osborn et al. | |
| 4,392,350 | A | | 7/1983 | Marks | |
| 4,452,047 | A | | 6/1984 | Hunt et al. | |
| 4,454,426 | A | | 6/1984 | Benson | |
| 4,499,726 | A | * | 2/1985 | Bratt | 60/517 |
| 4,616,140 | A | | 10/1986 | Bratt | |
| 4,625,514 | A | * | 12/1986 | Tanaka et al. | 60/517 |
| 4,664,685 | A | | 5/1987 | Young | |
| 4,707,990 | A | | 11/1987 | Meijer | |
| 4,719,755 | A | * | 1/1988 | Nagatomo et al. | 60/525 |
| 4,723,411 | A | | 2/1988 | Darooka et al. | |
| 4,768,341 | A | | 9/1988 | Nozaki et al. | |
| 4,894,989 | A | * | 1/1990 | Mizuno et al. | 60/517 |
| 5,404,723 | A | * | 4/1995 | Parker et al. | 60/641.15 |
| 5,875,863 | A | | 3/1999 | Jarvis et al. | |
| 6,050,092 | A | | 4/2000 | Genstler et al. | |
| 6,094,912 | A | | 8/2000 | Williford | |
| 6,161,381 | A | * | 12/2000 | Lohrmann | 60/523 |
| 6,513,326 | B1 | * | 2/2003 | Maceda et al. | 60/517 |
| 6,688,303 | B2 | | 2/2004 | Davenport et al. | |
| 6,735,946 | B1 | | 5/2004 | Otting et al. | |
| 6,871,495 | B2 | | 3/2005 | Otting et al. | |
| 6,952,921 | B2 | * | 10/2005 | Qiu | 60/517 |
| 2002/0121816 | A1 | | 9/2002 | Qiu et al. | |
| 2004/0222636 | A1 | | 11/2004 | Otting et al. | |

FOREIGN PATENT DOCUMENTS

| | | | |
|---|---|---|---|
| EP | 163801 | A1 | 12/1985 |
| GB | 2125157 | A | 2/1984 |
| JP | 3286170 | A | 12/1991 |

* cited by examiner

*Primary Examiner*—Hoang M Nguyen
(74) *Attorney, Agent, or Firm*—Carlson, Gaskey & Olds, PC

(57) ABSTRACT

A method and apparatus for producing electrical energy from a thermal dynamic cycle. The apparatus can include a heat exchange apparatus portion that allows for a large surface area for thermal energy collection while maintaining an efficiency of the thermal dynamic cycle engine. For example, a Stirling engine can include a large heater head portion that can be contained within the pressure vessel of the thermal dynamic engine yet maintain the selected size of the various pistons of the thermal dynamic cycle engine.

23 Claims, 5 Drawing Sheets

THERMAL CYCLE ENGINE WITH AUGMENTED THERMAL ENERGY INPUT AREA

FIELD

The present teachings relate generally to thermal cycle engines; and particularly to a thermal energy input system for a thermal cycle engine.

BACKGROUND

It is generally known to provide an engine that can be powered by various non-chemical and mechanical means. For example, thermal differences can be used to power an engine to produce mechanical force and/or electrical power through an alternator. The thermal dynamic engines use various thermal dynamic cycles that are harnessed to provide the mechanical energy for various engines. Various thermal cycles include Stirling cycles, brayton cycles, and rankine cycles can be used. These various cycles can be employed in engines using the same or similar name as the engine.

Generally, each of these engines can produce energy from one of the related thermal dynamic cycles. The thermal dynamic cycles and the related engines can require a differential in thermal energy to create the mechanical and electrical energy from the engine. Nevertheless, efficiency, control, and effectiveness of the various engines using the thermal dynamic cycles is difficult.

For example, a Stirling cycle engine is a thermal energy to a mechanical energy conversion device that uses a piston assembly to divide a fixed amount of gas between at least two chambers. The chambers are otherwise connected by a gaseous/fluid passage equipped with a heat source, recuperation, and heat sink exchangers. The piston assembly can have at least two piston heads that are separated and act on both chambers simultaneously through mutual coupling. As the volume in one chamber is increased, the volume in the other chamber decreases and vice versa, although not strictly to the same degree since one of the piston heads may have a greater area or volume than the other piston head by design.

The movement of the piston assembly in either direction can create an elevation of pressure in the chamber that experiences a decrease in volume while the other chamber experiences an increase in volume and decrease in pressure. The pressure differential across the two chambers decelerates the pistons, and causes a flow of gas from one chamber to the other, through the connecting fluid passage with its heat exchangers.

The heat exchangers tend to either amplify or accentuate the gas volume flowing through them, depending on whether the gas is either heating or cooling as it flows through the fluid exchange. The fluid exchange, also a regenerator heat exchanger, stores heat from the hot end gas as it flows to the cool end. Likewise the regenerator gives up heat to the cooler gas coming from the cold end. This improves the efficiency of the thermal cycle.

The character of the piston assembly as a finite massive moving object now comes into play according to the laws of motion and momentum. The piston will overshoot the point at which the pressure forces across the piston are in balance. Up to that point, the piston has had an accelerating pressure differential force that charges it with kinetic energy of motion. Once the net forces on the piston balance, the acceleration ceases, but the piston moves on at its maximum speed. Soon the pressure differential reverses and the piston decelerates, transferring its kinetic energy of motion into gas pressure/volume energy in the chamber toward which the piston has been moving up to this point. The increased pressure in the chamber now accelerates the piston in the opposite direction to the point where it reaches its maximum velocity in the opposite direction at the force balance point, and then decelerates as an increasing pressure differential builds in the other chamber. Once again, the piston stops, reverses direction, and repeats the process anew. This is a case of periodic motion as the energy is passed from the form of kinetic energy in the piston assembly to net pressure/volume energy in the chambers.

The periodic motion tends to be damped by small irreversibilities, especially the gas that is pumped back and forth from one chamber to the other through the fluid passage. This is the normal case for a Stirling engine in an isothermal state. When it is thermally linked to hot source and cool sink reservoirs at the source and sink heat exchangers respectively, the gas flowing into one of the chambers is heated while the gas flowing into the chamber on the other side is cooled. In this way, a given mass of pressurized cool gas sent to the hot chamber is heated and amplified in volume to a sizable shove. Conversely, a given mass of hot gas leaving the hot side chamber is reduced in volume as it is cooled by passage through the heat exchangers, and the cooled gas push in the cool side chamber is thereby attenuated dramatically due to the reduced volumetric flow of the cooler gas. Thereby, a change in the piston position, and its affects on gas temperature and pressure within the Stirling cycle engine, cause portions of the hot reservoir thermal energy to turn into periodic mechanical piston energy and gas pressure/volume energy, and the remaining thermal energy to flow to the cool reservoir in periodic fashion.

The compressible gas within the two chambers and the piston moving between those chambers form a spring-mass system that exhibit a natural frequency. Similarly, the motion of gas between the two chambers has its own natural frequency of a lower order. The conversion of thermal energy to mechanical within this system would cause such a system have successively higher amplitudes until mechanical interference or some other means of removing the energy appears. For many commercial Stirling cycle heat engine systems, a power piston operating at the same frequency, but out of phase with heat engine piston, is used to remove the excess mechanical energy and convert it into useful work.

One way to produce this energy conversion is to use the time varying position of the power piston to produce a time varying magnetic flux in an electrical conductor. This produces an electromotive potential which can be consumed locally, or remotely over transmission lines, by connection to an electrical appliance such as a motor, battery charger, or heater. Commonly, this is done by using the power piston to drive an alternator mover through a mechanical link. The alternator mover is what converts a time varying position within the alternator into time varying magnetic flux in the alternator electrical conductor(s).

Stirling cycle engines can be designed and tuned for optimal efficiency at various different temperatures for the source heat exchanger. The heat source can be any appropriate heat source. For example solar thermal energy, combustion thermal energy, or any appropriate heat source. The engine can be designed to utilize the general thermal output of the selected source The engine output, generally in watts, is usually in proportion to its size. Thus, a larger engine produce more energy than a small energy. The efficiency of the engine, however, can decrease as the size increases. Because the engine is based on kinetic movement of pistons within a chamber the size of the piston can reduce energy out put per unit of thermal input if it is too large.

Further, The engines can be operated at high pressures. Thus, a high pressure chamber can surround the engine. This can reduce the practicality of venting or contacting any of the internal components with the atmosphere as the pressure differential could be high.

Thus, it is desirable to provide an engine with high power output while maintaining a selected piston size, such as volume or mass. Further, it is desirable to provide an engine that can be enclosed in a selected size pressure vessel with minimal portions contacting or extending into the atmosphere.

SUMMARY OF THE INVENTION

According to various embodiments a thermal dynamic cycle engine system can be filled with a gas for producing electrical energy. The thermal dynamic cycle engine system can include a heater head with a heat exchanger. The heat exchanger can have a cylinder including an annular wall, a passage defined in the annular wall, and a pressure equalization port. The thermal dynamic cycle engine system can also include a cool head and a displacer piston operable to move relative to the heater head and the cool head to move the gas. The gas can be operable to move through the heat exchanger to the cool head.

According to various embodiments a system for providing electrical energy is disclosed. The system can have a thermal dynamic cycle engine. The thermal dynamic cycle engine can have a heater head with a heat exchanger including a cylinder including an annular wall, a passage defined in the annular wall, and a pressure equalization port. The thermal dynamic cycle engine can also include a cool head and a displacer piston operable to move relative to the heater head and the cool head to move the gas. The system can further have a power conversion system and a power transfer system. The power produced by the power conversion system can be transferred with the power transfer system to a load.

According to various embodiments a method of producing electrical energy with a thermal dynamic cycle engine including a heater head including a heat exchanger including a cylinder including an annular wall, a passage defined in the annular wall, and a pressure equalization port; a cool head; and a displacer piston operable to move relative to the heater head and the cool head to move the gas is disclosed. The method includes positioning the heat exchanger, the cool head, and the displacer piston in a pressure vessel. The pressure vessel can be pressurized to a selected pressure. A volume enclosed by the heat exchanger can be pressurized to the selected pressure when pressurizing the pressure vessel. During operation of the thermal dynamic engine a pressure differential in the pressure vessel can be minimized.

Further areas of applicability of the present teachings will become apparent from the detailed description provided hereinafter. It should be understood that the detailed description and various examples are intended for purposes of illustration only and are not intended to limit the scope of the present teachings.

BRIEF DESCRIPTION OF THE DRAWINGS

The present descriptions will become more fully understood from the detailed description and the accompanying drawings, wherein.

DETAILED DESCRIPTION OF THE VARIOUS EMBODIMENTS

The following description of various embodiments is merely exemplary and is in no way intended to limit the scope of the invention, its application, or uses. Furthermore, although the following description relates specifically to a thermal dynamic cycle engine using the Stirling cycle to produce power, it will be understood that any appropriate thermal dynamic engine may be used. For example, the teachings herein can be equally well suited to operate and optimize a thermal dynamic cycle engine using the Brayton cycle or other appropriate thermal dynamic cycles.

Figure 1:
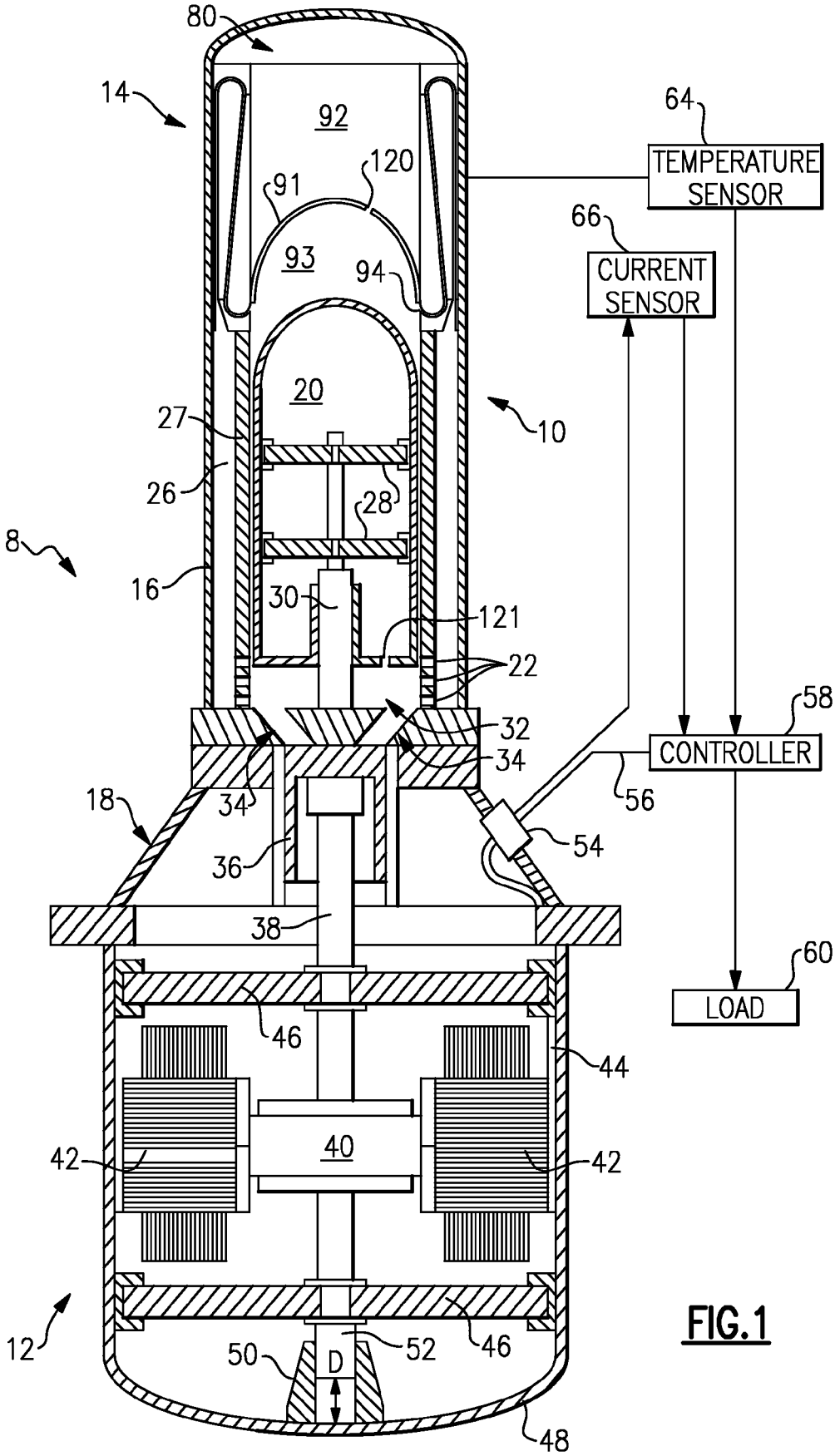
FIG. 1 is a thermal dynamic engine employing the Stirling cycle according to an embodiment of the invention.

With reference to FIG. 1, a thermal dynamic cycle engine power creation and transfer system 8 is illustrated. The system 8 includes a Stirling cycle engine 10 that is operably interconnected with an alternator 12. In this way, mechanical energy created in the Stirling cycle engine 10 can be transformed to electrical energy with the alternator 12. Again, it will be understood that any appropriate thermal dynamic cycle engine may be used in place of the Stirling cycle engine 10. In addition, any appropriate alternator may be used as the alternator 12 to provide for a conversion of the mechanical energy produced by the Stirling cycle engine 10 to electrical energy.

The Stirling cycle engine 10 generally includes a hot region or heater head 14 and a cool region or cool head 16. The heater head 14 can include a heat exchanger as described in further detail herein generally positioned in an area to receive or collect thermal energy. The cool head 16 may be interconnected with a radiator (not illustrated). The Stirling engine 10 and the alternator 12 can be interconnected and contained within a substantially continuous shell or pressure vessel 18. It will be understood, however, that the Stirling engine 10 and the alternator 12 may be substantially individual or separate portions interconnected and joined using any appropriate means, such as welding, sealing, or otherwise. Because the shell 18 is substantially continuous and sealed, it defines a predetermined volume of gas to operate the Stirling engine 10. The shell 18 can be pressurized with the gas to any appropriate pressure, such as about 300 psia. Moreover, it substantially seals the Stirling engine 10 and the alternator 12 from outside atmospheric gases. Generally, the gases contained within the shell 18 are those that are heated and cooled to operate the Stirling engine 10.

Although operation of the Stirling engine 10 is generally known in the art, a brief description is provided below for reference. The shell 18 of the Stirling engine 10 encloses a specific volume of gas that is able to travel around and/or relative to a displacer piston 20. The displacer piston 20 is positioned substantially movably or dynamically sealing against walls of the Stirling engine 10 or conduits can be provided for the gas to travel around the displacer piston 20. That is, the displacer piston 20 need not touch the walls but form a gap that is small enough to not allow a substantial amount of gas to pass during operation of the engine. For example, cooling end conduits 22 can be positioned near the cool head 16 of the Stirling engine 10. In addition, heating head end conduits or inlets 94 (discussed further herein) can be positioned near the heating end 14 of the Stirling engine 10. Therefore, gases may travel through the cooling end conduits 22 and inlet 94 around the displacer piston 20. Generally, the gases can travel through a gas transfer conduit and/or regenerator 26 which is generally defined by an exterior or between an exterior and an intermediate wall of the Stirling engine 10.

The displacer piston 20 can be held within the Stirling engine 10 by a plurality of flexure bearings or springs 28. Generally, the flexure bearings 28 allow the displacer piston 20 to oscillate or vibrate along an axis defined by the displacer rod 30. The displacer rod 30 can be affixed or mounted to a portion of the Stirling engine 10 such that it is relatively immobile relative to the Stirling engine 10 while the displacer piston 20 can vibrate relative to the displacer rod 30. The displacer piston 20 can form a dynamic seal, as discussed above, with an intermediate wall 27 of the Stirling engine 10. Therefore, the gases are forced to travel through the respective conduits or inlets 22, 94, and 26 as the displacer piston 20 vibrates relative to the displacer rod 30. Moreover, the flexure springs 28 allow for axial motion relative the displacer rod 30 but not transverse motion relative to the displacer rod 30. Also, the displacer piston can include a piston port 121 similar to the port 120 of the heat exchanger, as further discussed herein.

As the displacer piston 20 moves axially relative to the displacer rod 30, the gases enclosed within the shell 18 can move through a passage 32 as well. The gases that pass through the passage 32 compress in the compression space 34. A power piston 36 can be contained within and substantially seals the compression space 34, therefore allowing an insignificant volume of gas to pass the power piston 36. Therefore, substantially all the force of the gas that is forced into the compression space 34 by the displacer piston 20 moves the power piston 36.

The power piston 36 is interconnected with an alternator rod 38. The alternator rod 38 is also interconnected or includes a magnetic material or portion 40. Substantially surrounding the magnetic portion 40 are a plurality of windings 42. The windings 42 are interconnected with a power transfer line 44 to allow electricity to be removed from the alternator 12. Generally, as the magnetic portion 40 vibrates along the axis relative to the windings 42, an electromotive force (emf) is created. This electromotive force is transferred through the power transfer line 44 out of the alternator 12 as a voltage.

The alternator rod 38 generally vibrates along an axis which is maintained by a plurality of flexure bearings 46 within the alternator 12. The flexure bearings 46 allow the alternator rod 38 to vibrate along an axial dimension with little or no vibrating transversely thereto. At a closed end 48 of the alternator 12 is an additional bushing or holding member 50. This holding member 50 additionally helps hold a second end 52 of the alternator rod 38 in place. Also, the alternator rod is generally displaced a distance D from the end 48 of the alternator 12. During operation of the Stirling engine 10 which moves the alternator rod 38 in the alternator 12, the second end 52 of the alternator rod 38 moves closer to the end 48 of the alternator 12. Generally, the distance D will vary over the cycle of the Stirling engine 10. However, if the distance D becomes substantially zero or less than zero, the Stirling engine "knocks". When the Stirling engine 10 and the alternator 12 knocks, the alternator rod 38 engages or collides with the end 48 of the alternator 12. Controlling the stroke length or the load of the alternator 12, however, can minimize or eliminate the possibility of knocking.

The power line 44 is generally interconnected with a coupling 54 while an external power line 56 is connected therein to transfer the voltage from the system 8 (described further herein). A controller 58 can also be connected with the coupling 54 and can adapt the load being provided to the alternator 12 by a load 60 being taken or the power being taken from the alternator 12. Such control systems include those disclosed in U.S. patent application Ser. No. 10/434,311, filed on May 8, 2003 and U.S. Pat. No. 6,871,495 issued on Mar. 29, 2005, both of which are incorporated herein by reference. The load and current can be adjusted with the controller to optimize power transfer and operation of the system 8. The controller 58 can then determine how much power can be used for a load 60. The load 60 may include a present user load, battery, or parasitic load. In addition, various sensors such as a temperature sensor 64 and a current sensor 66 can be used by the controller 58 to determine an optimal load to be placed on from the alternator 12 to ensure for an optimal operation of the alternator 12 and the respective Stirling engine 10.

Figure 2:
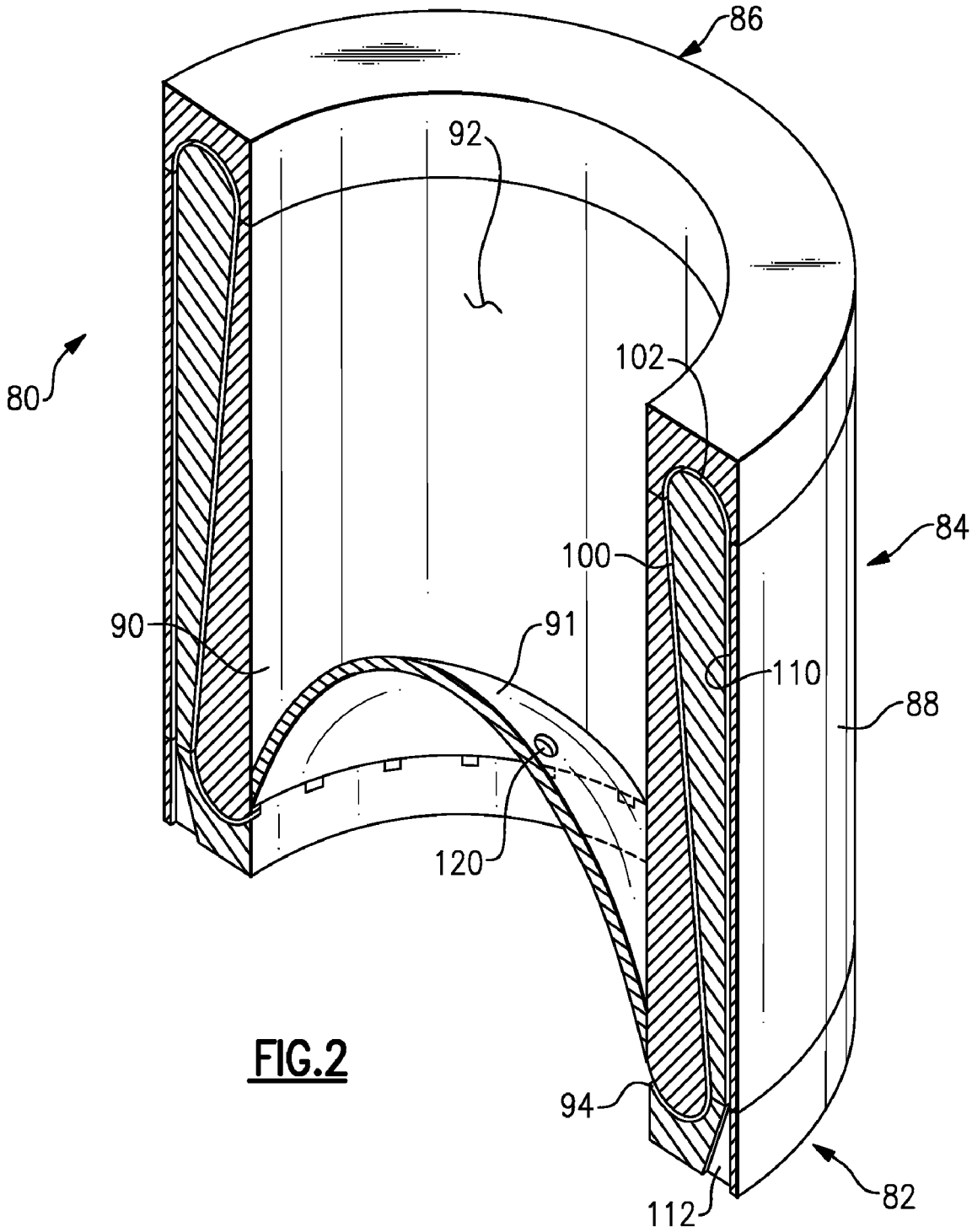
FIG. 2 is a cross-sectional bottom perspective view of a heat exchanger according to various embodiments.
Figure 3:
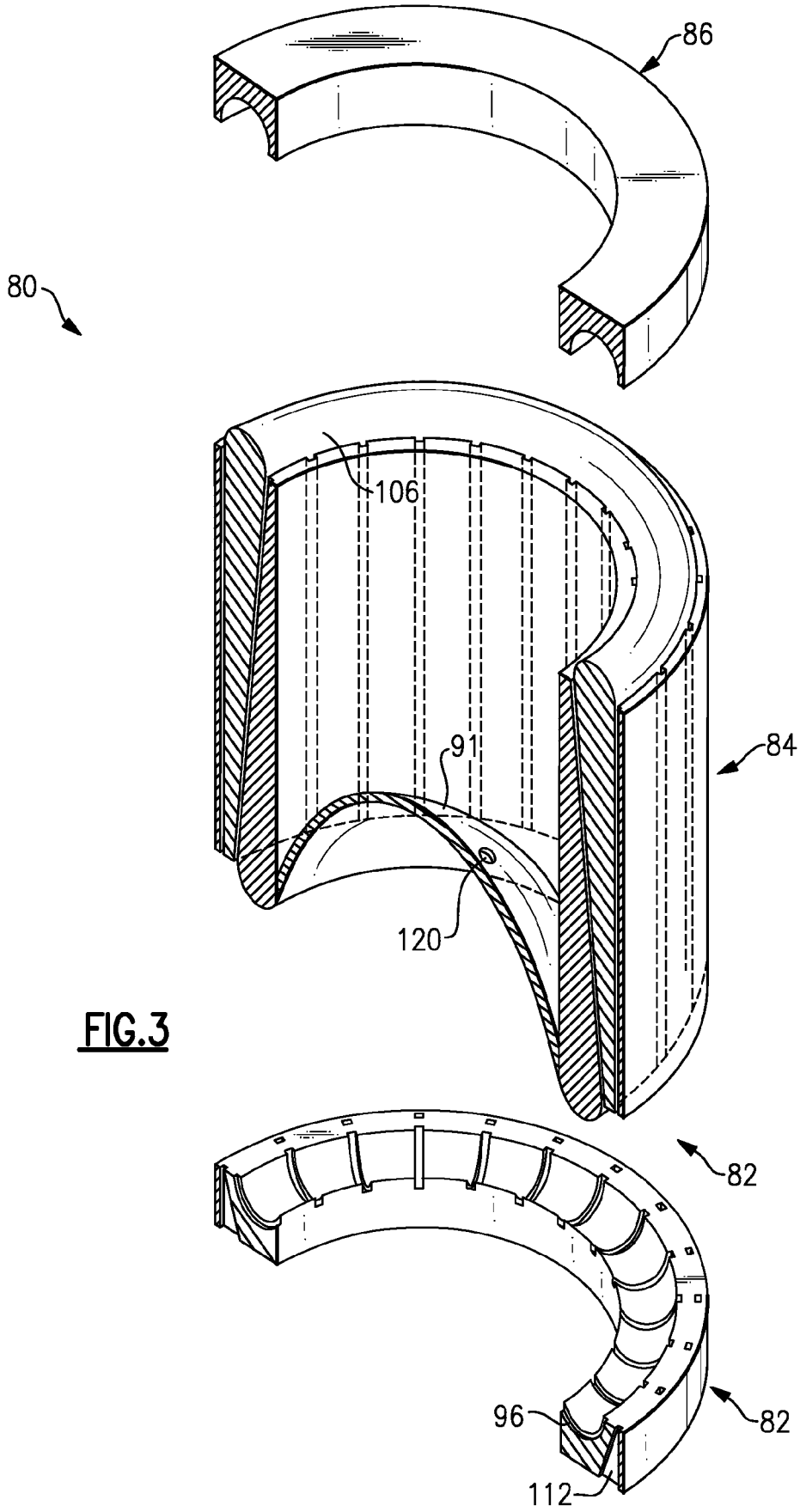
FIG. 3 is a cross-sectional exploded bottom perspective view of a heat exchanger according to various embodiments.
Figure 4:
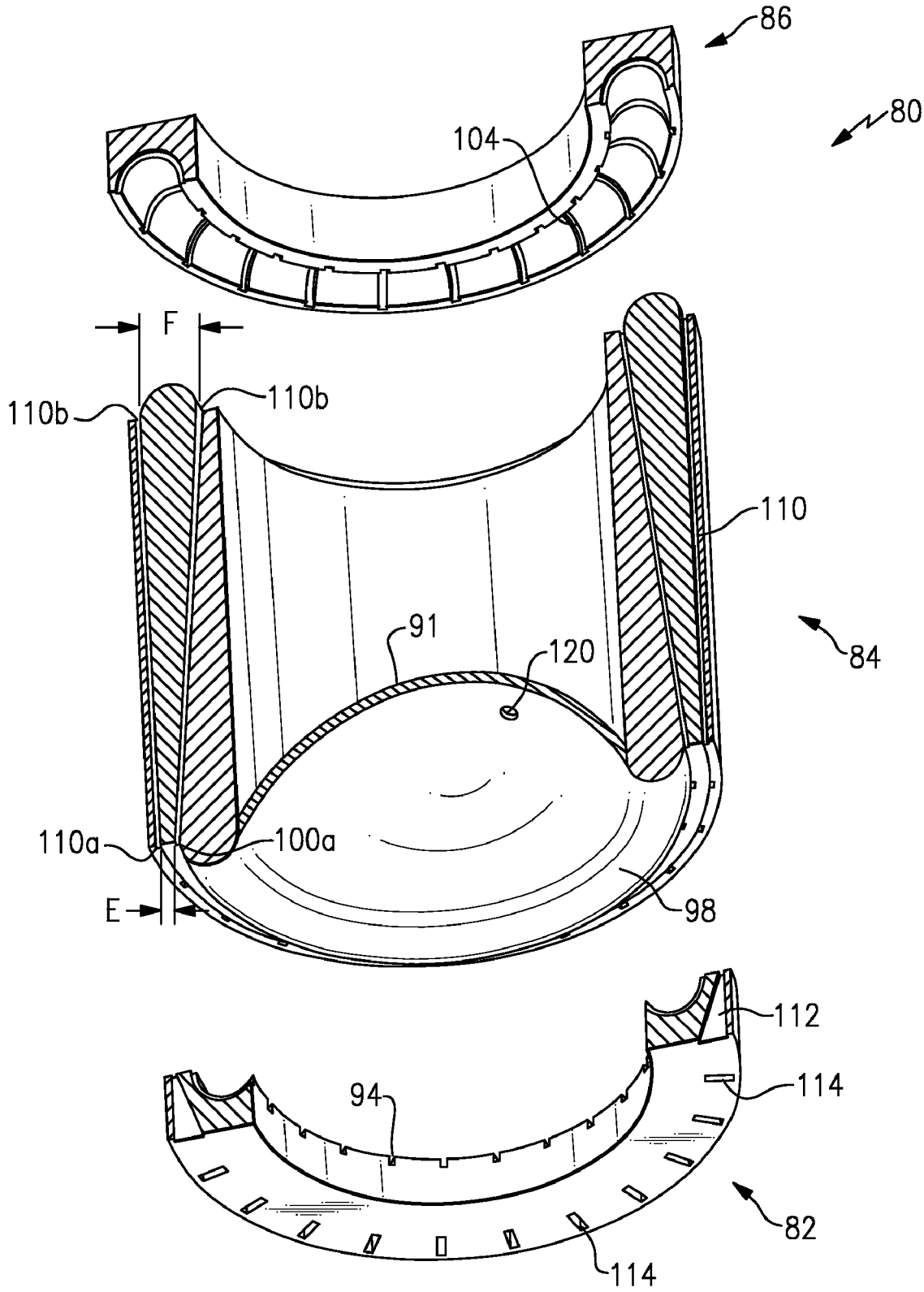
FIG. 4 is a cross-sectional top perspective view of a heat exchanger according to various embodiments.
Figure 5:
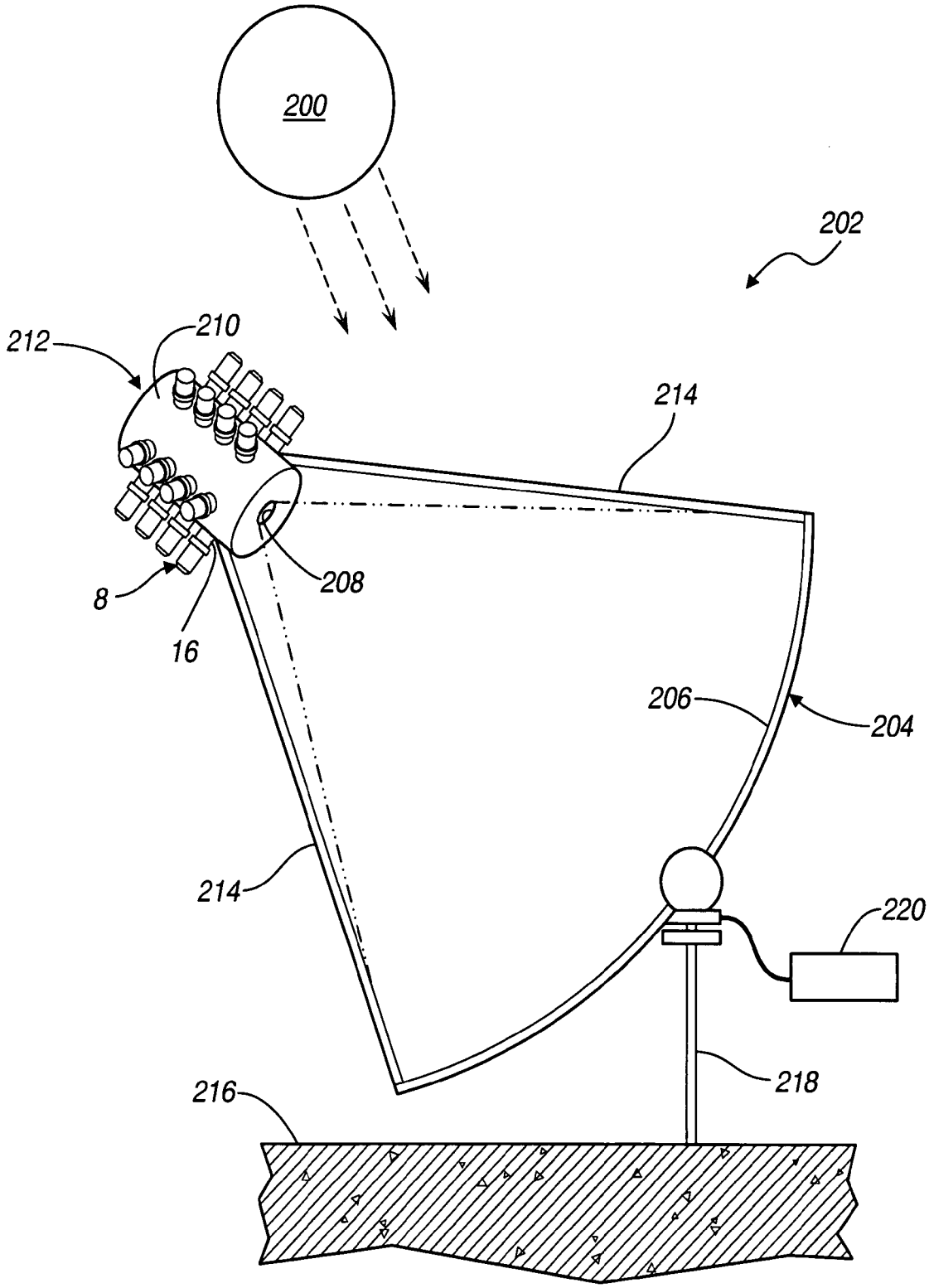
FIG. 5 is an environmental view of a system using a thermal dynamic cycle engine.

The hot portion or heater head 14 may include a heat exchanger 80 illustrated in FIGS. 2-4. The heat exchanger 80 can include a first or lower portion 82, a middle portion 84, and an upper portion 86. It will be understood, however, that the heat exchanger 80 need not be provided in three pieces, and it will also be understood that the heat exchanger 80 can be provided in more than three pieces. The heat exchanger 80 may be formed as a single unit including the various structures, as discussed further herein in this single unit. Further, the heat exchanger 80 may be formed in a plurality of units greater than the number of three, such as dividing the middle portion 84 into more than a single piece. It will be understood that the heat exchanger 80 can be formed in any selected number of pieces depending upon the characteristics of the selected system 80, the materials used, manufacturing consideration, and the like. Thus, the heat exchanger 80 can be used in the heater head 14.

The heat exchanger 80 defines an exterior surface 88 and an interior surface 90. The heat exchanger 80 can also include a stationary baffle 91, which can define, in part, a portion of the interior surface 90. As discussed herein, the stationary baffle 91 can define a port 120. Further, the interior surface 90 can surround and contain a volume or area 92. The volume 92 can be an open or void or can be filled with a selected material. For example, the volume 92 can be filled with an insulating material that can contact or be near the inner wall 90. The insulating material can be provided for various purposes, such as maintaining a selected temperature in the heat exchanger 80 or any other appropriate reason. The stationary baffle 91 separates the volume 92 from a working volume 93.

As discussed above, the Stirling engine 10 generally works by the transport of gasses due to thermal or pressure differences formed within the Stirling engine 10. The heat exchanger 80 can be used to heat a selected portion of the gas placed in the system 8 as discussed above. Further, as discussed above, the Stirling engine 10 works by transferring or moving gasses within the system 8, particularly within the wall 88.

The heat exchanger 80 defines a passage 92 allowing gasses to pass through the heat exchanger 80 and the passage 92. The passage 92 can include an inlet passage 94 defined in the, or at least partially in, the first heat exchanger portion 82. The inlet passage 94 can include a depression 96 defined by the lower heat exchanger portion 82 and an upper containment area 98 defined by the middle heat exchanger portion 84. This heat exchanger 82 can be formed with a selected geometry for interconnection with the middle heat exchanger portion 84. It will be understood, however, that the inlet passage 94 can be defined completely by either the lower heat exchange portion 82 or the middle heat exchanger portion 84.

The inlet passage 94 can interconnect with a first traversing passage 100. The first transverse passage 100 is formed through a portion of the middle heat exchanger portion 84. The gasses that enter the inlet passage 94 can travel along the first transverse passage 100. The first transverse passage 100 can be defined completely by the middle heat exchanger portion 84 or may be defined by a plurality of portions or including the middle heat exchanger portion 84.

A turning passage 102 can be defined near the upper heat exchange portion 86. The turning passage 102 can be defined by a recess 104 in the upper heat exchanger portion that engages an upper portion 106 of the middle heat exchanger portion 84. Similar to the lower heat exchanger portion 82 defining the recess 96 that is enclosed by the lower portion 98 of the middle heat exchanger portion.

A second transverse passage 110 extends generally along the length of the middle heat exchanger portion 84 to an outlet portion 112 in the lower heat exchanger portion 82. The outlet portion 112 can include an outlet port 114 (FIG. 4) that allows the gasses that enter the inlet passage 94 to finally exit the heat exchanger 80.

The first transverse passage 100 and the second transverse passage 110 can be parallel or non-parallel. For example, as exemplary illustrated, a first end 100*a* of the first transverse passage 100 is a distance E from a first end 110*a* of the second transverse passage 110. This is different from a distance F between the second end 100*b* of the first transverse passage 100 and a second end 110*b* of the second transverse passage 110. Therefore, the distances E and F can be the same or different depending upon whether the first transverse passage 100 is parallel or not parallel to the second transverse passage 110. It can be selected to have the transverse passages not be parallel to increase the area through which the gasses travel to obtain thermal energy from the heat exchanger 80. Nevertheless, for various purposes, such as manufacturing or the like, the first transverse passage 100 can be substantially parallel to the second transverse passage 110. The distance F can also allow for a large radius to minimize the pressure drop of the gasses as they pass through the passage 92.

As exemplary illustrated, a plurality of each of the portions, including the inlet 94, the first transverse passage 100, the turning passage 102, the second transverse passage 110, and the outlet portion 112 are provided. Nevertheless, it will be understood that each of these portions can be defined by a space between various portions of the heat exchanger 80. For example, the first transverse passage 100 and the second transverse passage 110 can be defined as a space between an inner boundary portion, a middle portion, and an outer boundary portion. Thus, the transverse passages 100, 110, need not be formed as a plurality of portions within the middle heat exchanger portion 84, but can be substantially continuous or annularly defined by a plurality of cylinders of the heat exchanger 80. Nevertheless, the heat exchanger 80 can be provided with the plurality of ports for various reasons. For example, the plurality of ports, the geometry thereof, the size thereof, or the like, can be used to regulate a gas flow within the Stirling engine 10.

The heat exchanger 80 can be formed of any appropriate material to assist in transferring the thermal energy from a thermal energy source to the gas that flows through the passage 92. The various materials can exemplary include metal, metal alloys, composites, and other appropriate materials. For example high strength nickel, nickel alloys, or other metal alloys with a high percentage of nickel can be used to form the heat exchanger.

Further, the heat exchanger 80 can include the pin pole or gas transfer hole or port 120. The gas transfer port 120 can be provided in the heat exchanger to allow for the pressure of the charge gas that is positioned in the system 8 to fill the heat exchanger, or a portion thereof. This allows the heat exchanger 80 to be pressurized to the same pressure as the remainder of the system 8. As discussed above, the system 8 can be run at any selected pressure such as about 300 psia. The charge gas is contained within the shell 18. Therefore, the pressure differential between the interior and the exterior of the heat exchanger 80 would be substantially minimal after the system 8 has been charged. This is substantially achieved by containing the heat exchanger 80 within the wall 88 of the system 8. Thus, although the port 120 allows the heat exchanger 80 to be charged during the charging of the system 8, the port 120 can be small enough to substantially eliminate a pressure differential being formed within the heat exchanger 80 during operation of the Stirling engine 10. The displacer piston 20 can also include a similarly sized piston port 121.

The port 120 can be any appropriate dimension including a radius of about 0.000125 millimeters to about 0.0254 millimeters (about 0.000005 in. to about 0.001 in.). The hole may also define an area of about such as defining an area of about $4.90625\times10^{-8}$ mm$^2$ to about 0.002026 mm$^2$. As discussed above, the displacer piston 20 oscillates within the Stirling engine 10, as the displacer piston 20 oscillates the gasses can be forced through the channel 92 and the various other portions, as discussed above. The port 120, however, can be provided of the selected dimension to substantially minimize the amount of gas or the volume of gas that is able to move in and out of the heat exchanger 80. Therefore, the amount of gas passing through the port 120 during operation of the Stirling engine 10 is substantially negligible. Nevertheless, the port 120 allows the heat exchanger 80 to be charged to the pressure of the system 8 for operational efficiency, such as minimal pressure differentials within the shell 18.

Generally, charging the heat exchanger 80 to the operating pressure of the system 8 allows the heat exchanger 80 to be efficiently manufactured. For example, the pressure differential that the heat exchanger 80 is exposed to, because it is pressurized to the pressure of the system 8, is substantially minimal. The pressure within the shell 18 is substantially equivalent throughout the entire shell 18, therefore the heat exchanger 80 is not required to withstand pressure differentials or they are minimized. Therefore, the heat exchanger 80 can be substantially light, connected together with efficient joints, such as brazing materials, and include an efficient construction. This also allows longevity of the system because even small leaks can be tolerated in the system and it will still maintain at least a majority of its efficiency. Further, the port 120 and piston port 121 form substantially dynamic seals in the system as they are formed small enough to not effect pressure differentials during the operational frequency.

Further, the distance F defined between the first transverse channel 100 and a second transverse channel 110 can be selected to be substantially maximized for the particular Stirling engine to which the heat exchanger 80 is interconnected. That is the radius defined within the upper heat exchange portion 86, or simply the radius of the channel 92 near the upper portion 86 can be substantially maximized to minimize a pressure drop as the gasses move through the heat exchanger 80. The minimization of the pressure drop can increase efficiency of the system and allow for maintaining the high operating pressure within the system 8.

A method and apparatus for producing electrical energy from a thermodynamic cycle engine is also disclosed. The apparatus can include a heat exchange apparatus portion which allows for a large surface area for thermal energy collection while maintaining the efficiency of the thermodynamic cycle engine. For example, a Stirling engine can include a large heater head portion that can be contained within the pressure vessel of the thermodynamic engine yet maintain a selected size of the various pistons of the thermodynamic cycle engine.

As discussed above, the Stirling engine system 8 can be used for a plurality of applications. For example, the system 8 can be a size to provide a selected amount of watts for a substantially portable system. For example, the system 8 can be sized to be substantially portable by a single user in an efficient manner. The system 8 can then be heated with any appropriate system, such as solar energy, chemical energy, combustion energy, or the like. Further, the system 8 can be sized to provide any substantial amount of power, such as kilowatts or megawatts.

The system 8 can be used to convert thermal energy provided by a star 200, such as the sun. The star 200 can provide thermal energy to a power production system 202. The power production system can include a collector, such as a solar collector 204. The solar collector 204 can include a collecting surface 206.

The collecting surface 206 can substantially focus the thermal or light energy from the star 200 to a collection area 208. The collection area 208 can be defined by a housing 210. The housing 210 can be part of an energy production system or Stirling housing 212. The housing 210 can include or be interconnected with a plurality of the system 8. Generally, the system 8 includes the cool head 16 and are generally near an exterior of the housing 210 while the heater head 14 is positioned within the housing 210.

As the light energy and thermal energy are collected by the collecting surface 206 and focused into the collection housing 210, it is heated to provide the thermal energy required for operation of the Stirling engine system 8.

Further, the housing 210 can be held relative to the collection face with various support portions 214. Further the collection dish 212 can be held relative to a surface 216 with a stand 218. A controller 220 can be used to assist in assuring that the collection surface 206 is generally pointed or faced near or towards the star 200.

Therefore, it will be understood that the Stirling engine system 8 can be used in any appropriate application. The system 8 can be used in a substantially portable system, such as providing energy for a portable radio or communication system. Alternatively, or in addition thereto, the system 8 can be used for a high power output application which can include converting solar energy into electrical energy.

The description of the teachings is merely exemplary in nature and, thus, variations that do not depart from the gist of the teachings are intended to be within the scope of the teachings. Such variations are not to be regarded as a departure from the spirit and scope of the teachings.

What is claimed is:

1. A heater head for a Stirling cycle system, comprising:

a heat exchanger defined by a heat exchanger wall which defines an interior volume, said heat exchanger wall having a passage defined therein, said wall defines a wall thickness defined between an inner wall and an outer wall, said passage defining an inner passage portion adjacent said inner wall and an outer passage portion adjacent said outer wall, said inner passage portion non parallel to said outer passage portion; and a stationary baffle which separates said interior volume from a working volume, said stationary baffle having a port therethrough said stationary baffle generally concave toward said interior volume.

2. The heater head as recited in claim 1, wherein said port defines a radius of about 0.000125 millimeters to about 0.0254 millimeters (about 0.000005 in. to about 0.001 in.).

3. The heater head as recited in claim 1, wherein said port defines an area of about 4.90625×10-8 mm2 to about 0.002026 mm2.

4. The heater head as recited in claim 1, wherein said port facilitates charging of said heat exchanger with the gas.

5. The heater head as recited in claim 1, wherein said passage defines a radius near one end segment of said wall that interconnects the inner passage portion and the outer passage portion.

6. The heater head as recited in claim 5, wherein said radius is maximized relative to said thickness.

7. The heater head as recited in claim 5, wherein said radius is generally opposite said stationary baffle.

8. The heater head as recited in claim 5, wherein said inner passage portion is in communication with an inlet adjacent said stationary baffle.

9. The heater head as recited in claim 8, wherein said inner passage defines a radius adjacent a second end segment adjacent said stationary baffle.

10. The heater head as recited in claim 8, wherein said inlet is defined through an inner diameter of a lower portion of said heat exchanger.

11. The heater head as recited in claim 5, wherein said outer passage portion is in communication with an outlet adjacent said stationary baffle.

12. The heater head as recited in claim 11, wherein said outlet is defined through a bottom surface of a lower portion of said heat exchanger.

13. The heater head as recited in claim 1, wherein said heat exchanger is contained within a pressure vessel.

14. A heater head for a Stirling cycle system, comprising:

a heat exchanger upper portion;

a heat exchanger lower portion, said heat exchanger lower portion having an inlet defined through an inner diameter of said heat exchanger lower portion and an outlet defined through a bottom surface of said heat exchanger lower portion, said inner diameter of said heat exchanger lower portion generally transverse to said bottom surface;

a heat exchanger middle portion between said heat exchanger upper portion and said heat exchanger lower portion, said heat exchanger middle portion having a heat exchanger wall which defines an interior volume, said heat exchanger wall having a passage defined thereby, said passage having an inner passage portion adjacent an inner wall of said heat exchanger wall and an outer passage portion adjacent an outer wall of said heat exchanger wall, said inner passage portion non parallel to said outer passage portion, said inner passage portion in communication with said inlet and said outer passage portion in communication with said outlet, said inner passage portion in communication with said outer passage portion at a turning passage defined by said heat exchanger upper portion; and a stationary baffle which separates said interior volume from a working volume, said stationary baffle generally concave toward said interior volume.

15. The heater head as recited in claim 14, wherein said stationary baffle defines a port therethrough, said port defines a radius of about 0.000125 millimeters to about 0.0254 millimeters (about 0.000005 in. to about 0.001 in.).

16. The heater head as recited in claim 14, wherein said stationary baffle defines a perimeter generally adjacent a perimeter of said inner diameter of said heat exchanger lower portion.

17. The heater head as recited in claim 14, wherein said port defines a radius of about 0.000125 millimeters to about 0.0254 millimeters (about 0.000005 in. to about 0.001 in.).

18. A thermal dynamic cycle engine system, comprising:

a pressure vessel having an exterior wall;

a heat exchanger contained within said exterior wall, said heat exchanger defined by a heat exchanger wall which defines an interior volume, said heat exchanger wall having a heat exchanger passage defined therein, said heat exchanger passage having an inlet and an outlet;

a stationary baffle which separates said interior volume from a working volume, said inlet in communication with said working volume, said stationary baffle generally concave toward said interior volume;

a displacer piston movable adjacent said intermediate wall relative said stationary baffle; and a cool head adjacent said heat exchanger, said cool head defining a regenerator passage defined by an intermediate wall and said exterior wall, said outlet from said heat exchanger passage in communication with said heat exchanger passage, said regenerator passage having a cooling end conduit adjacent said displacer piston opposite said stationary baffle.

19. The system as recited in claim 18, further comprising an alternator rod in communication with said displacer piston, said alternator rod operable to drive an alternator.

20. The system as recited in claim 18, further comprising a port through said stationary baffle, said port in communication with said interior volume and said working volume, said stationary baffle is generally concave toward said interior volume.

21. The system as recited in claim 18, further comprising a piston port through said displacer piston, said piston port in communication with said cooling end conduit.

22. The system as recited in claim 18, wherein said heat exchanger comprises:

a heat exchanger upper portion;

a heat exchanger lower portion, said heat exchanger lower portion having an inlet defined through an inner diameter of said heat exchanger lower portion and an outlet defined through a bottom surface of said heat exchanger lower portion, said inner diameter of said heat exchanger lower portion generally transverse to said bottom surface; and a heat exchanger middle portion between said heat exchanger upper portion and said heat exchanger lower portion, said heat exchanger middle portion having a heat exchanger wall which defines an interior volume, said heat exchanger wall having a passage defined therein, said passage having an inner passage portion adjacent an inner wall of said heat exchanger wall and an outer passage portion adjacent an outer wall of said heat exchanger wall, said inner passage portion non parallel to said outer passage portion, said inner passage portion in communication with said inlet and said outer passage portion in communication with said outlet.

23. The heater head as recited in claim 14, wherein said inner passage portion in communication with said outer passage portion at a turning passage defined by said heat exchanger upper portion, said inlet communicates with said inner passage portion through a turning passage defined by said heat exchanger lower portion.

* * * * *